US006301844B1

(12) United States Patent
Richardson

(10) Patent No.: US 6,301,844 B1
(45) Date of Patent: Oct. 16, 2001

(54) GLAZED ROOFS

(75) Inventor: Christopher Richardson, Clitheroe (GB)

(73) Assignee: Ultraframe (UK) Limited, Clitheroe (GB)

( * ) Notice: Subject to any disclaimer, the term of this patent is extended or adjusted under 35 U.S.C. 154(b) by 0 days.

(21) Appl. No.: 09/506,183

(22) Filed: Feb. 17, 2000

(51) Int. Cl.[7] ..... E06B 7/00

(52) U.S. Cl. ..... 52/204.591; 52/214; 52/204.5; 52/204.57

(58) Field of Search ..... 52/204.5, 214, 52/204.57, 204.591, 90, 478, 173.3

(56) References Cited

U.S. PATENT DOCUMENTS 4,555,879 12/1985 Cheater .
5,740,996 4/1998 Genschorek .

FOREIGN PATENT DOCUMENTS 521153 3/1982 (AU) .
19 810722 9/1998 (DE) .
596545 5/1994 (EP) .
2459352 1/1981 (FR) .
2306996 5/1997 (GB) .

*Primary Examiner*—Carl D. Friedman
*Assistant Examiner*—Patrick J. Chavez
(74) *Attorney, Agent, or Firm*—Rockey, Milnamow & Katz, Ltd.

(57) ABSTRACT

A support for glazing panels for use in constructing pitched glazed roofs comprises a bracket securable to a glazing bar, a peg positionally adjustable relative to the bracket and securable thereby and a buffer mountable on the peg for abutment by a glazing panel.

16 Claims, 2 Drawing Sheets

GLAZED ROOFS

BACKGROUND OF THE INVENTION

This invention concerns glazed roofs.

Conservatories with pitched roofs can be made either with glass or plastics glazing panels. The panels are held in place by cappings secured to glazing bars and pressed down onto panels. Glass panels are relatively heavy and will tend to slip downwards under their own weight unless supported at bottom edges.

Plastics roofing panels, whilst being lighter than equivalent glass panes may also be liable to slip downwards, especially if the roof pitch is over 35° and/or there is expansion of the glazing bars or cappings.

It is known to provide pegs or the like fitted to glazing bars or to eaves beams against which glass panels abut to prevent downwards slippage thereof. However, contact with the glass panels is over a very small area and can cause damage to the glass panels.

Furthermore, in some roof situations, such as for hipped roofs, the panels do not have their bottom edges at right angles to glazing bars supporting them along their sides, which can put greater pressure on supporting pegs.

SUMMARY OF THE INVENTION

An object of this invention is to provide an improved support for glazing panels whether of glass or plastics for use in constructing pitched glazed roofs, such as of conservatories and that may be used in different pitched roof situations.

According to this invention there is provided a support for glazing panels for use in constructing pitched glazed roofs comprising a bracket securable to a glazing bar, a peg adjustably positionable relative to the bracket and securable thereby and a buffer mountable on the peg for abutment by a glazing panel.

The peg is preferably at one end of a plate and the plate and bracket preferably have mutually engaging formations. More preferably, the plate and bracket have mutually engaging ratchet surfaces, whereby once the bracket has been secured to a glazing bar, the plate can be moved under the bracket to a desired position but cannot be pulled back therefrom by the weight of a panel abutting the buffer on the peg.

The buffer preferably comprises a sleeve that fits onto the peg. The buffer is preferably made of rubber, neoprene or any other suitable elastomeric material. The buffer is preferably shaped to provide at least two bearing surfaces that can be selectively used to abut a glazing panel. The peg preferably has a base that has a major dimension and a minor dimension and the major dimension of the peg is preferably angled at other than 90° to a longitudinal axis of the plate. The peg preferably has one shorter side chamfered so that the peg narrows upwardly from its base.

The sleeve has an aperture corresponding in size and shape to the peg i.e. having a major dimension and a minor dimension. The at least two bearing surfaces of the buffer are preferably of different lengths, a shorter bearing surface being generally parallel to the major dimension of the sleeve aperture and a longer bearing surface being at an acute angle to said major dimension of the sleeve aperture. The bearing surfaces are preferably not smooth and are preferably undulating or ridged for grip.

The buffer can, therefore, be used in different orientations to suit the situation. The buffer can be used with either a longer or a shorter bearing surface presented to the glazing panel to be supported and can be used either way up, so that the presented bearing surface is parallel to the supported edge of the glazing panel.

For practical purposes, the angle of the peg and the relative angles of the bearing surfaces of the buffer are chosen to enable the support to be used in a transom rafter situation at 90°, a Victorian hip situation at 67° and a Georgian hip situation at 45°.

BRIEF DESCRIPTION OF THE DRAWINGS

This invention will now be further described, by way of example only, with reference to the accompanying drawings, in which.

DETAILED DESCRIPTION OF THE INVENTION

Figure 1:
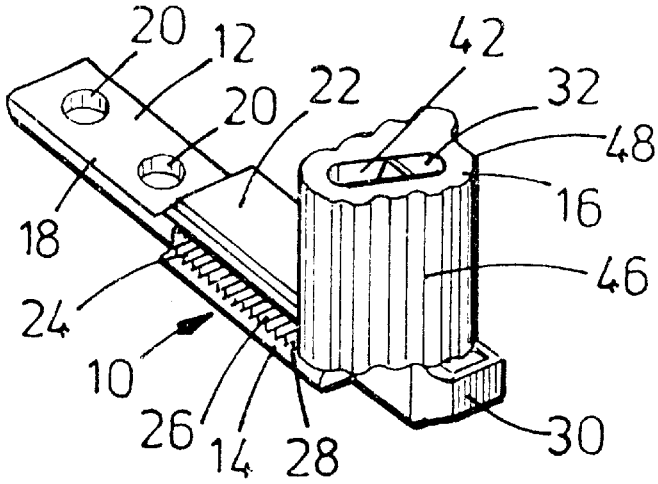
FIG. 1 shows a glazing panel supporting clip for use in forming a glazed roof.
Figure 2:
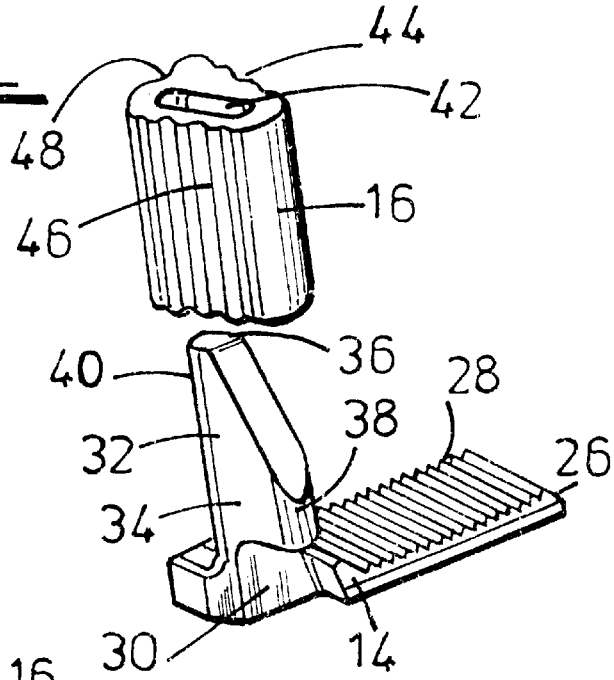
FIG. 2 shows separated components of the clip of FIG. 1.

Referring to FIGS. 1 and 2 of the accompanying drawings, a glazing panel supporting clip 10 for use in forming a glazed roof of glass or of plastics panels has a bracket 12 securable to a glazing bar, a peg plate 14 and a neoprene buffer 16. The bracket 12 has a first part 18 provided with screw holes 20, whereby the bracket can be fixed to a glazing bar, and a second part 22 stepped up from the first part and having ratchet teeth 24 on its underside.

The peg plate 14 has a first part 26 having a top surface 28 in the form of ratchet teeth, whereby the first part 26 can be pushed under the ratchet part of the bracket because of the direction of slope of the teeth but not withdrawn therefrom. The peg plate 14 has a second part 30 which extends from the first part but is rebated to one side, so that it is narrower than the first part but generally co-terminus with one side of the first part. Extending upwardly from the second part 30 of the peg plate is a peg 32. The peg 32 has a base extending beyond the rebated side of the second part of the peg plate to form an overhang. The peg 32 is generally rectangular in section at its base having a front wall 34, back wall 36 and opposed end walls 38, 40, the front and back wall having the major dimension at the base thereof. End wall 38 is chamfered over most of its length, so that the peg narrows towards its top in the plane of the major dimension of the base.

The longitudinal axis of the first part 26 of the peg plate and the major dimension of the base of the peg do not intersect at right angles and, in fact, the peg 32 is angled back towards the first part of the peg plate.

The peg 32 has fitted thereto the neoprene buffer 16, which is a generally tubular formation having a through aperture 42 corresponding in shape and size to that of the peg base. The chamfering of the peg allows the buffer to be fitted relatively easily onto the peg. The buffer is generally triangular in plan view having a first longer and a second shorter bearing surface (44, 46 respectively) at an acute angle to each other and a connecting side 48. The bearing surfaces are ridged to provide grip.

In use the bracket 12 is secured to a roof glazing bar by means of screws. The buffer 16 is fitted onto the peg 32 in the orientation appropriate to the situation of the glazing bar and the peg plate 14 pushed under the bracket until the buffer bears against the glazing panel supported on the glazing bar in order to prevent the glazing panel from slipping downwards.

Figure 3:
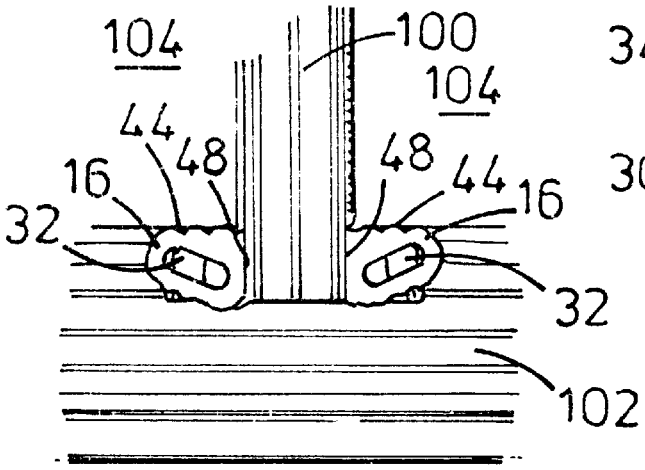
FIG. 3 shows clips of FIG. 1 used in a transom rafter situation.
Figure 4:
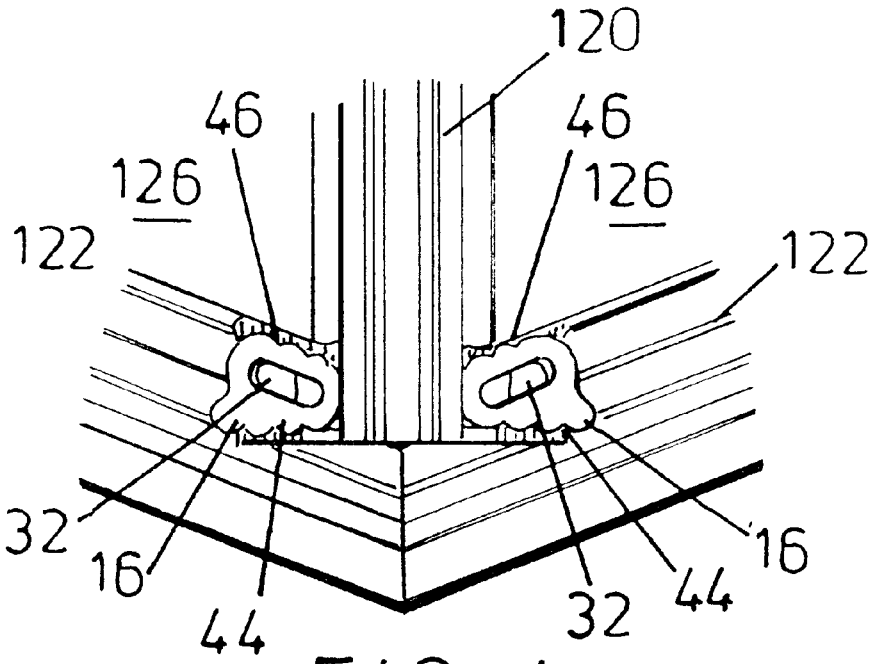
FIG. 4 shows clips of FIG. 1 used in a Victorian style conservatory roof hip situation.
Figure 5:
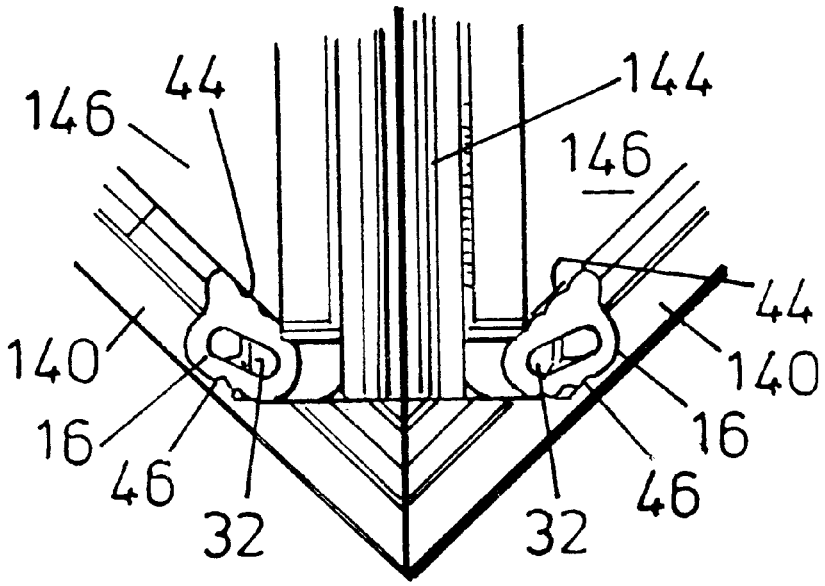
FIG. 5 shows clips of FIG. 1 used in a Georgian style conservatory roof hip situation.

The buffer 16 can be fitted to the peg 32 in different orientations in order to suit the situation of the glazing bar. Three possible situations are shown in FIGS. 3, 4 and 5. In FIG. 3, glazing bar 100 is connected to an eaves beam 102 in a transom rafter situation i.e. at 90° to the eaves beam. In this situation, the buffer is fitted onto the peg with connecting side 48 against the glazing bar and the longer bearing surface 44 towards glazing panel 104. The same is repeated on both sides of the glazing bar.

Turning to FIG. 4 of the drawings, a Victorian style conservatory roof hip situation is shown, wherein a glazing bar 120 is connected to eaves beams 122 connected at an angle of 134°. In this situation glazing panels 126 on opposite sides of the glazing bar are supported by supporting clips 10 in which the buffers 16 are arranged with sides 44 away from the glazing bar and shorter bearing surfaces 46 towards the glazing panels 126.

Finally, in FIG. 5 of the drawings, a Georgian style conservatory roof hip situation is shown in which eaves beams 140 are connected at an angle of 90° with glazing bar 144 connected to their junction at 45° to each. In this situation the buffers 16 are the opposite way up compared to FIGS. 3 and 4 and are arranged so that their sides 46 are away from the glazing bar but their long bearing surfaces 44 are towards the glazing panels 146 supported on either side of the glazing bar 144.

The glazing panels for which supporting clips 10 may be used include glazing panels of glass or of plastics material, such as polycarbonate or polyvinyl chloride.

What is claimed is:

1. A support for glazing panels for use in constructing pitched glazed roofs, the support comprising a bracket securable to a glazing bar, a peg positionally adjustable relative to the bracket and securable thereby and a buffer mountable on the peg for abutment by a glazing panel.

2. A support as claimed in claim 1, wherein the peg is at one end of a plate.

3. A support as claimed in claim 2, wherein the plate and the bracket have mutually engaging formations.

4. A support as claimed in claim 3, wherein the plate and bracket have mutually engaging ratchet surfaces.

5. A support as claimed in claims 1, wherein the buffer comprises a sleeve that fits onto the peg.

6. A support as claimed in claim 1, wherein the buffer is made of rubber, neoprene or other elastomeric material.

7. A support as claimed in claim 1, wherein the buffer is shaped to provide at least two bearing surfaces for selective use to abut a glazing panel.

8. A support as claimed in claims 7, wherein the peg has a base that has a major dimension and a minor dimension.

9. A support as claimed in claim 8, wherein the major dimension of the peg is angled at other than 90° to a longitudinal axis of the plate.

10. A support as claimed in claim 9, wherein the peg has one shorter side chamfered, so that the peg narrows upwardly from its base.

11. A support as claimed in claim 8, wherein the buffer comprises a sleeve having an aperture corresponding in size and shape to the peg.

12. A support as claimed in claim 11, wherein the at least two bearing surfaces of the buffer are of different lengths.

13. A support as claimed in claim 12, wherein a shorter bearing surface is generally parallel to the major dimension of the sleeve aperture.

14. A support as claimed in claim 12, wherein a longer bearing surface is at an acute angle to the major dimension of the sleeve aperture.

15. A support as claimed in claim 7, wherein the bearing surfaces are not smooth for grip.

16. A support as claimed in claim 15, wherein the bearing surfaces are undulating or ridged for grip.

* * * * *